US009291042B2

(12) United States Patent
Lamb et al.

(10) Patent No.: US 9,291,042 B2
(45) Date of Patent: Mar. 22, 2016

(54) WATER INJECTION METHOD FOR ASSISTING IN RECOVERY OF HEAVY OIL

(71) Applicant: SUNRISE OIL SANDS PARTNERSHIP, Calgary (CA)

(72) Inventors: Derek Lamb, Calgary (CA); Lawrence J. Frederick, Calgary (CA)

(73) Assignee: Sunrise Oil Sands Partnership, Calgary (CA)

( * ) Notice: Subject to any disclaimer, the term of this patent is extended or adjusted under 35 U.S.C. 154(b) by 547 days.

(21) Appl. No.: 13/633,658

(22) Filed: Oct. 2, 2012

(65) Prior Publication Data

US 2014/0020891 A1 Jan. 23, 2014

(30) Foreign Application Priority Data

Jul. 20, 2012 (CA) ..... 2783439

(51) Int. Cl.
*E21B 43/24* (2006.01)

(52) U.S. Cl.
CPC ..... *E21B 43/24* (2013.01); *E21B 43/2406* (2013.01)

(58) Field of Classification Search
CPC ..... E21B 43/162; E21B 43/166; E21B 43/20; E21B 43/24; E21B 43/25; E21B 43/2406; E21B 43/2408
See application file for complete search history.

(56) References Cited

U.S. PATENT DOCUMENTS

| | | | | |
|---|---|---|---|---|
| 6,591,908 | B2 | 7/2003 | Nasr | |
| 2010/0218954 | A1 | 9/2010 | Yale | |
| 2010/0252249 | A1 * | 10/2010 | Diehl et al. | 166/60 |
| 2012/0085537 | A1 | 4/2012 | Banerjee | |
| 2012/0168158 | A1 * | 7/2012 | Nasr et al. | 166/270.1 |
| 2012/0285700 | A1 * | 11/2012 | Scott | 166/369 |

OTHER PUBLICATIONS

Axe Lake SAGD Test Horixontal Well pair Configuration Project Summary Document, Oilsands Quest, Jul. 14, 2010, pp. 1-11, Alberta, Canada.
Section 4.0—Bitumen Recovery Process, Telephone Lake Project, Dec. 2011, vol. 1—Project Description, Cenovus TL ULC Alberta, Canada.
A.L. Aherne, Fluid Movement in the SAGD Process: A Review of the Dover Project, One Petro, Jul. 8, 2012, 2 pages, www.onepetro.org.

* cited by examiner

*Primary Examiner* — Robert E Fuller
*Assistant Examiner* — David Carroll
(74) *Attorney, Agent, or Firm* — Frost Brown Todd LLC

(57) ABSTRACT

A steam-assisted gravity drainage or cyclic steam injection method for recovering oil from a development region of an underground reservoir, further employing water injection along one or more peripheral side edges of the development region via a horizontal well or wells to thereby bound the development region on at least one side edge thereof, and preferably along two or more side edges, with water to thereby reduce steam loss from the development region and thus reduce steam-to-recovered oil ratio (SOR). The water may be combined with diluents. The water which is injected into the horizontal well or wells may comprise produced water recovered from said reservoir.

21 Claims, 11 Drawing Sheets

10
C
C
22'b
26'
22'a
11'
42'b
200'
100'
42'a
22b
26
22a
11
42b
200
100
42a

WATER INJECTION METHOD FOR ASSISTING IN RECOVERY OF HEAVY OIL

FIELD OF THE INVENTION

The present invention relates to a heavy oil extraction process, and more particularly to a thermal oil recovery method for producing oil from subterranean hydrocarbon deposits using steam injection, where fluid injection (typically water or brine) is further employed.

BACKGROUND OF THE INVENTION

Waterflooding of portions of an underground reservoir to assist in producing heavy oil from underground hydrocarbon-containing reservoirs has been employed in the past.

Specifically, in a prior art application of the method of water flooding for assisting in producing oil from a formation, using a vertical production well to produce oil from an underground oil-containing formation, water is injected via vertical injection wells surrounding the single oil production well, in an attempt to maintain pressure in the reservoir (also known as voidage replacement) and/or sweep or displace the oil from the reservoir and push it towards the vertical oil production well, where it can then be produced to surface.

Waterflooding using horizontal wells as opposed to vertical wells was introduced by Taber in 1992 as a method for improving the performance of conventional waterfloods. The rationale for this geometry is that water can theoretically be injected at much higher rates and lower pressures in horizontal wells than in vertical wells, allowing oil to be recovered quicker. In one embodiment of the prior-art horizontal waterflooding process, a central horizontal water injection well is provided, adjacent to which are provided two parallel horizontal producing wells. The basic technique concept employed is that a large amount of water can be injected into the horizontal injector well at pressures that are below the fracture-parting pressure, displacing the oil laterally outwardly from the horizontal water injector well, to allow such migrated oil to then be recovered in each of the parallel horizontal producing wells.

Moreover, waterflooding is ineffective in bitumen containing formations, as bitumen does not flow unless heated, and in particular unless heated to temperatures much higher than original formation temperature.

As an alternative oil recovery method, steam-based oil recovery methods are commonly employed to recover heavy oil and particularly bitumen. For example, steam-assisted-gravity-drainage (SAGD) and cyclic steam stimulation (CSS) are used for the recovery of heavy oil or bitumen.

In a SAGD (Steam Assisted Gravity Drainage) method of oil recovery, a horizontal steam injector well is drilled relatively high in a hydrocarbon-containing formation, and a parallel horizontal production well is drilled low in the formation, having a horizontal portion typically situated directly below the horizontal portion of the injector well. Steam is injected into the formation via the horizontal portion of the injector well, and oil within the formation which becomes heated thereafter becomes mobile and by force of gravity drains downwardly in the formation, where it is collected by the horizontal production well and produced to surface.

In a cyclic steam stimulation (CSS) method, one or more wells are drilled into a development region of a hydrocarbon-containing reservoir. Steam is initially injected into the well(s) for a period of time to heat bitumen and heavy oil in a region of the formation surrounding the well(s). After a time injection of steam is stopped, and oil which has been heated and rendered mobile is allowed to drain into the well, and is produced to surface. The cycle is repeated numerous times.

Due to high levels of oil recovery (substantially greater than 30% of OOIP), SAGD and CSS oil recovery methods are often a superior means of producing oil from an underground reservoir, particularly where heavy oil and in particular bitumen deposits are encountered.

Disadvantageously, however, oil recovery percentages using only SAGD or CSS recovery methods are typically in only in the range of about 50% recovery (depending on factors including reservoir quality and thermal properties, and the like). Moreover, and also disadvantageously, the Steam/Oil ratio (SOR) with respect to SAGD and CSS methods is often very high, meaning that considerable expense and effort need be undertaken when using SAGD or CSS recovery methods to heat significant quantities of water to produce large volumes of steam in order to obtain the higher rates and levels of oil recovery. In addition, in numerous locations where heavy oil reservoirs may exist, sources of water may be rare or legislatively restricted due to environmental concerns regarding consumption of water to produce large quantities of steam.

Thus new methods of oil recovery are needed to reduce the SOR ratio, and reduce volumes of water needed in SAGD and CSS recovery methods.

Specifically, a real need exists for a method of oil recovery which achieves as high (or higher) a percentage of recovery of original oil in place (OOIP) as current SAGD or CSS methods, but which has a lower steam/recovered oil ratio and thus a lower operating cost to achieve such percentage recovery levels and/or rates of recovery.

SUMMARY OF THE INVENTION

An object of the present invention is to provide an oil recovery method which employs a thermal recovery method such as SAGD or CSS for recovery of oil from a formation and thus achieves relatively high rates of oil recovery (ie relatively high percentage recovery of OOIP), but has a lower steam/produced oil ratio (SOR) than a simple SAGD or CSS method.

The method of the present invention involves drilling of one or more horizontal or vertical liquid injection wells along one or more side edges of a development area of an underground hydrocarbon-containing formation which is being developed using thermal methods such SAGD or CSS methods, to accomplish one or more of: (i) reducing steam requirements by reducing migration of steam condensate away from the well drainage area; (ii) preventing mobilized oil from flowing away from the well drainage area and thus away from the production well.

Advantageously, in the method of the present invention, water injection, and SAGD or CSS are combined in a unique manner such that the resulting improved method of the present invention achieves as high or higher percentage recovery of original oil in place as SAGD or CSS methods but with a lower steam/recovered oil ratio.

Alternatively, for identical quantities of steam injected, the method of the present invention allows potentially greater percentage recovery of original oil in place (ie greater rates of recovery of oil) from a formation.

Accordingly, in a first broad embodiment the method of the present invention uses water injection along at least one side, and preferably two sides, and even potentially three or all four sides of a development area in a formation undergoing thermal recovery methods, to create a no flow barrier that works to prevent or reduce escape of steam or steam condensate from the development region within the reservoir being exploited, to thus better heat the region under development and improve thermal efficiency. In addition, such injected water may also serve to prevent heated oil from flowing outside a zone of recovery of the horizontal production well.

Specifically, in a first broad aspect of the method of the present invention, such method relates to an improved thermal method for recovering oil from a development region of a hydrocarbon-containing subterranean reservoir, comprising the steps of:

(i) drilling a first heated fluid injection well which has a portion which extends into said development region of said reservoir, said first heated injection well adapted for injecting a heated fluid such as steam into said development region to heat the oil so it may flow in said development region;

(ii) drilling a first production well having a portion which extends into said development region, said first production well adapted for collecting the so-heated oil resulting from step (i) from said development region;

(iii) drilling at least one liquid injection well along at least one side edge of said development region;

(iv) injecting a heated fluid such as steam into said first heated fluid injection well and into said development region via said first heated fluid injection well;

(v) injecting a liquid such as water into said liquid injection well along said one side edge of said development region; and (vi) collecting and producing to surface heated oil within said reservoir which has flowed into said production well.

The improved thermal recovery method of the present invention may employ continuous injection of a heated fluid into the first heated fluid injection well, in which case as noted above a separate collection well is drilled, in addition to a separate liquid injection well or wells.

Alternatively, the improved method of the present invention may be adapted to a CSS recovery method. Specifically, in such an alternative embodiment employing cyclic heated fluid injection (eg cyclic steam injection), such improved thermal method for recovering oil from a development region of a hydrocarbon-containing subterranean reservoir comprises the steps of:

(i) drilling a first well which extends into said development region of said reservoir, said first well adapted for periodically (a) injecting a heated fluid such as steam into said development region so as to heat the oil so it may flow in said reservoir, followed by (b) collecting and producing the so-heated oil to surface;

(ii) drilling at least one liquid injection well along at least one side edge of said development region;

(iii) injecting a liquid such as water into said liquid injection well;

(iv) injecting a heated fluid such as steam into said development region via said first well for a time sufficient to heat the oil in said development region so that oil may flow in the reservoir; and (v) collecting and producing to surface heated oil after step (iv) from within said reservoir via said first well.

In a preferred embodiment above steps (iv) to (v) are repeated at least once, and preferably a number of times.

In a preferred embodiment of each of the above broad embodiments, injection and production wells which extends into the development region are substantially horizontal, and the at least one liquid injection well which extends along one side edge of the development region is likewise substantially horizontal and parallel to the horizontal portion of the first well.

In a further preferred embodiment thereof, the horizontal portion of the liquid injection well is located at a height in said development region approximately equal to that of the first well.

In a further embodiment of the improved thermal method for recovering oil from a development region of a hydrocarbon-containing subterranean reservoir being developed, such method comprises the steps of:

(i) drilling a first heated fluid injection well, having a horizontal portion extending into said development region and adapted for injecting a heated fluid such as steam into said development region;

(ii) drilling a first production well within said development region, having a horizontal portion situated parallel with but positioned below said horizontal portion of said heated fluid injection well, said production well adapted for producing oil from said development region;

(iii) drilling at least one liquid injection well along at least one side edge of said development region;

(iv) injecting a heated fluid such as steam into said heated fluid injection well and into said development region via said horizontal portion of said heated fluid injection well;

(v) injecting a liquid such as water into said liquid injection well; and (vi) collecting and producing to surface oil within said reservoir that has drained or been forced downwardly in said development region.

In a first embodiment of the above method, the step of drilling at least one liquid injection well comprises the step of drilling a plurality of liquid injection wells at locations which bound the development region, wherein the horizontal portion of said first production well extends into a central area of said development region.

In a further refinement, the drilling of at least one liquid injection well in step (iii) further comprises the step of drilling said liquid injection well in a manner so as to provide a horizontal portion thereof along at least one side edge of said development region, so as to bound said development region along said at least one side edge thereof.

In a still further refinement such method comprises drilling a pair of mutually parallel liquid injection wells, each having a horizontal portion positioned parallel to the horizontal portion of the fluid injection well and positioned on mutually opposite sides of the fluid injection well and thereby respectively bounding said development region along mutually opposite side edges thereof; and injecting said liquid into each of said liquid injection wells. In such manner the reservoir in the development region is bounded along two longitudinal edges, and both heated oil and steam and/or steam condensate is prevented or substantially prevented from migrating away from the horizontal producer and the region of the reservoir under development, and thus heat loss is reduced by minimizing migration of fluids away from the drainage area of the production well.

In a still further modification, such method comprises drilling a single or a pair of liquid injection wells, having a horizontal portion(s) extending outwardly in mutually opposite directions along one edge of said development region, each of said horizontal portion(s) thereof disposed perpendicular to said horizontal portion of said production well and said fluid injection well. In such manner the development region is bounded at one edge, and heated oil and steam and/or steam condensate is prevented from migrating away from the horizontal producer and the region of the reservoir under development and thus heat loss is reduced by minimizing migration of fluids away from the drainage area of the production well.

More specifically, in a further refinement of such further modification of the method of the present invention, such method comprises the steps of:

(i) drilling a first heated fluid injection well, having a horizontal portion for injecting a heated fluid such as steam into the development region;

(ii) drilling a first production well, having a horizontal portion positioned relatively low in said development region and parallel with but positioned below said horizontal portion of said first heated fluid injection well, for collecting and producing oil from said development region;

(iii) drilling a liquid injection well, having a horizontal portion substantially perpendicular to said horizontal portion of said production well and situated along at least a portion of one side of said development region so as to bound said development region along at least a portion of one side edge thereof;

(iv) drilling a pair of mutually parallel liquid injection wells, each positioned parallel to said horizontal portion of said production well along mutually opposite sides of said first heated fluid injection well so as to bound said development region along mutually opposite side edges thereof;

(iv) injecting a heated fluid such as steam into said first heated fluid injection well and into the development region via said horizontal portion of said fluid injection wells;

(v) injecting a liquid such as water into said liquid injection wells; and (vi) collecting and producing to surface oil within said development region that has become heated by said heated fluid and drained downwardly in said development region.

In the above embodiments the horizontal portions of said (first) fluid injection well and said (first) production well terminate after a finite length at a point of termination, at an end of said development region opposite said perpendicular liquid injection well. Accordingly, in a further refinement such method comprises, at said point of termination:

(i) drilling a second heated fluid injection well extending outwardly from said point of termination into another development region of said reservoir, having a horizontal portion that is parallel to said horizontal portion of said first fluid injection well and said first production well;

(ii) drilling a second production well, extending outwardly from said point of termination and having a horizontal portion situated relatively low in said another development region and parallel with but positioned below said horizontal portion of said second heated fluid injection well, for producing oil from said another development region of said reservoir;

(iii) drilling a further liquid injection well (or pair of liquid injection wells) at said point of termination, having a horizontal portion(s) perpendicular to said horizontal portions of said second fluid injection well and said second production well, and situated in said another development region above said second production well;

(iv) injecting a heated fluid such as steam into said second fluid injection well and into the another development region via said horizontal portion of said second fluid injection well;

(v) injecting a liquid such as water into said further liquid injection well; and (vi) collecting and producing to surface via said second production well oil within said another development region that has become heated by said heated fluid and drained downwardly in said development region.

Advantageously, such may be used as part of a further preferred embodiment (method) employing sequential or abutting development regions, where a series of horizontal injector and production wells are successively drilled in series, in end to end juxtaposed relation along a consistent direction in the reservoir/formation. In such further preferred method, each of said horizontal portions of a first fluid injection well and a first production well terminate after a finite length at a point of termination. At such point of termination a second heated fluid injection well is drilled, extending outwardly from said point of termination, having a horizontal portion that is parallel to both said horizontal portion of said first fluid injection well and said first production well. A second production well is drilled, extending outwardly from said point of termination and likewise having a horizontal portion situated relatively low in said development region and parallel with but positioned below said horizontal portion of said second heated fluid injection well. A pair of liquid injection wells are drilled at said point of termination, each having a horizontal portion extending outwardly and in mutually opposite directions, each horizontal portion disposed perpendicular to said horizontal portions of said second fluid injection well and said second production well. The heated fluid such as steam is then injected into said second fluid injection well and into the development region of the reservoir via said horizontal portion of said second fluid injection well, and a liquid such as water is injected into said further liquid injection wells, effectively creating a no flow barrier that works to prevent or reduce escape of steam or steam condensate from the development region thus heat loss is reduced by minimizing migration of fluids away from the drainage area of the production well. Oil which is heated and forced downwardly to the collection well is thereafter collected and produced to surface via said second production well.

In a preferred embodiment thereof the horizontal portions of the pair of liquid injection wells are situated above the second production well, at approximately a height within the another development regions as the second injection well therein.

The above sequential or continuous development method bounds one end of the region of the reservoir being developed with water injection, thereby reducing the tendency of heated oil and steam to flow into an area of the development region which has already been voided of oil by the previous thermal operation, and traps steam and oil in such region for collection. Such process is successively repeated for producing oil throughout the entirety of the reservoir/formation.

In yet a further refinement to the above sequential or continuous method, not only is a liquid injection well (or pair of wells) drilled at an end of the portion of the development region having the (first) fluid injection well and (first) collection well drilled therein, but in addition at least one (and preferably a pair) of liquid injection wells are further drilled along respectively opposite side edges of such first fluid injection and first collection well and thus along respective mutually opposite side edges of the development region of the reservoir. In such manner steam condensate and heated oil within the reservoir (or portion of the reservoir being developed, namely the development region) are effectively retained or partially trapped, due to water injection via the liquid injection wells on three (3) sides of the formation, within the development region, or at a minimum blocked from escaping along the three blocked sides of the development region, thus heat loss is reduced by minimizing migration of fluids away from the drainage area of the production well.

Such process can be repeated for each portion of reservoir which is exploited in the above manner, until the entire reservoir/formation has been exploited.

In other words, when exploiting another region of the reservoir adjacent to a first region of the reservoir that has been exploited, such embodiment in this further refinement comprises, at a point of termination of each of said horizontal portions of said first fluid injection well and said first production:

(i) drilling a second heated fluid injection well extending outwardly from said point of termination into another development region of said reservoir, having a horizontal portion that is parallel to said horizontal portions of said first fluid injection well and said first production;

(ii) drilling a second production well, extending outwardly from said point of termination and having a horizontal portion situated relatively low in said another development region and parallel with but positioned below said horizontal portion of said second fluid injection well, for producing oil from said another region of said reservoir;

(iii) drilling a liquid injection well, or pair of liquid injection wells, having a horizontal portion extending outwardly from a midpoint of said another region and in the case of a pair of horizontal liquid injection wells extending outwardly therefrom in mutually opposite directions, each of said horizontal portion(s) disposed perpendicularly to said horizontal portions of said second production well and said second fluid injection well and situated above said second production well;

(iv) drilling a further pair of mutually parallel liquid injection wells, each positioned parallel to said second production well and above said second production well along mutually opposite sides of said fluid injection well so as to bound said another region along mutually opposite side edges thereof;

(v) injecting a heated fluid such as steam into said second fluid injection well and into the another region via said horizontal portion of said second fluid injection well;

(vi) injecting a liquid such as water into each of said further liquid injection wells; and (vii) collecting and producing to surface via said second production well oil within said another region that has become heated by said heated fluid and drained downwardly in said another region.

The fluid used for heating in the method of the present invention, like in prior art SAGD and CSS methods, is preferably steam, which advantageously when contacting cooler oil condenses thereby further releasing heat into the oil via the latent heat of condensation, and is thus very effective in warming oil in the formation and thus increasing its mobility within the formation.

Notably, however, other fluids such as heated gases such as carbon dioxide (carbon dioxide further having the advantage as acting as a diluent to the oil and further increasing its mobility) will now occur to persons of skill in the art. Likewise, it will now be apparent to persons of skill in the art that steam mixed with various diluents such as naptha or diesel, either in vapour or liquid form, may also advantageously be used in the method of the present invention for increasing recovery of oil from the region of the reservoir under development.

Likewise with respect to the injected liquid, such injected liquid is preferably water (in liquid state), and more preferably water that has been produced from the formation and is simply being recycled back in to the formation. Where brackish or saline water (brine) is produced with the oil using the method of the present invention, the method of the present invention advantageously allows for such saline water to simply be re-injected back into the development region using any of the methods of the present invention, thereby not only operating to improve the rate and/or percentage of recovery of oil, but also advantageously affording a manner of conveniently disposing of such saline or brackish water without having to otherwise treat and dispose of such water at surface in accordance with certain environmental requirements and conditions.

BRIEF DESCRIPTION OF THE DRAWINGS

In the accompanying drawings, which illustrate one or more exemplary embodiments and are not to be construed as limiting the invention to these depicted embodiments.

DETAILED DESCRIPTION OF THE PRIOR ART AND PREFERRED EMBODIMENTS OF THE PRESENT INVENTION

Figure 1B:
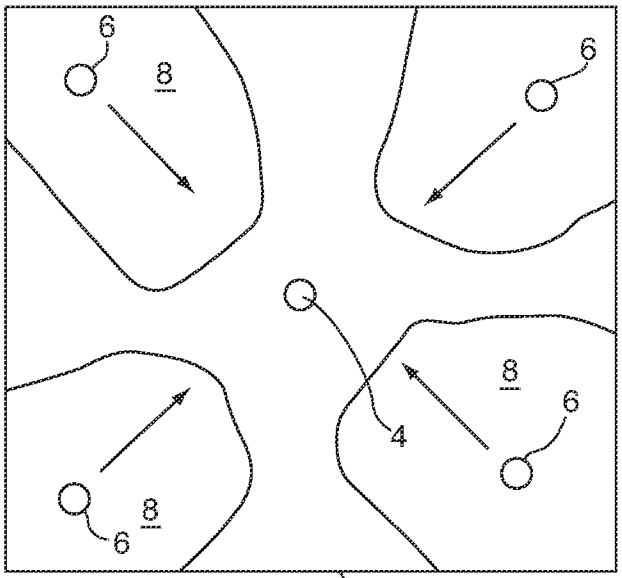
Fig.1b ( Prior Art )
FIG. 1*b* is a schematic top view of the prior art waterflooding method of FIG. 1*a*, showing the action of the four (4) liquid injection wells surrounding the centrally-located vertical production well, on the oil in the formation and the directing of the water (and the oil in the formation) in the direction of the four (4) arrows shown in FIG. 1*b;*
Figure 1A:
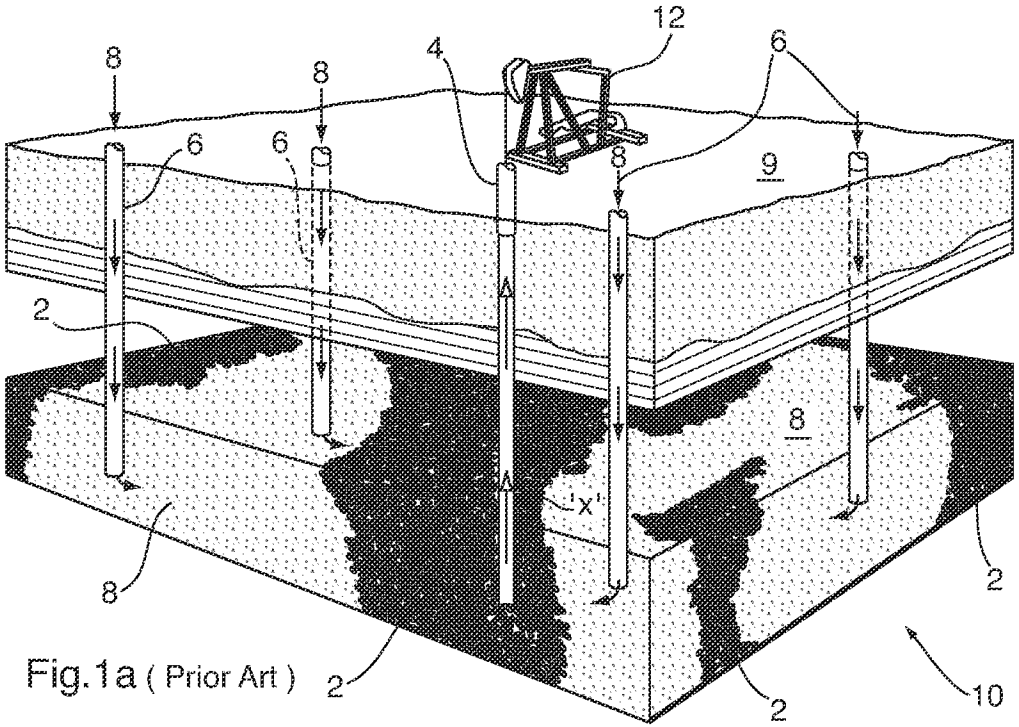
Fig.1a ( Prior Art )
FIG. 1*a* is a perspective schematic view of a prior art method employing waterflooding to assist in extracting oil from an underground formation, using a vertical production well for withdrawing oil from the reservoir, wherein such vertical production well is surrounded by a plurality of vertical water injection wells which inject water into the formation and attempt to force such water towards the vertical production well, and further act to maintain the pressure of the oil being produced to surface.

FIG. 1*a* shows a perspective schematic view of a prior art method employing waterflooding to assist in extracting oil 2 from an underground formation (reservoir) 10, using a vertical production well 4 and (typically) a conventional pumpjack 12 for withdrawing such oil 2 from the reservoir 10, wherein such vertical production well 4 is surrounded by a plurality of vertical water injection wells 6 which inject water 8 into the formation 10 and attempt to force such water 8 towards the vertical production well 4, and further act to maintain the pressure of the oil 2 being produced to surface 9.

FIG. 1*b* is a schematic top view of the prior art waterflooding method of FIG. 1*a*, showing the action of the four water injection wells 6 surrounding the centrally-located vertical production well 4, on the oil 2 in the formation 10 and the directing of the water 8 (and the oil 2 in the formation 10) in the direction of the four arrows shown in FIG. 1*b*, namely toward the vertical production well 4.

Disadvantageously, however, as mentioned in the background of the invention herein, the prior art water flood technique as shown in FIG. 1*a* and FIG. 1*b* has inefficient percentage recovery of the oil originally in place, due to variable permeability, fluid solubility, sweep efficiency (an influencing factor therein being rock porosity within the formation 10), often resulting in early water breakthrough to the production well 4 such as at location "X" which results in both not only lack of production of oil, but also surface processing problems of the resulting oil/water mixture produced to surface 9.

Figure 2:
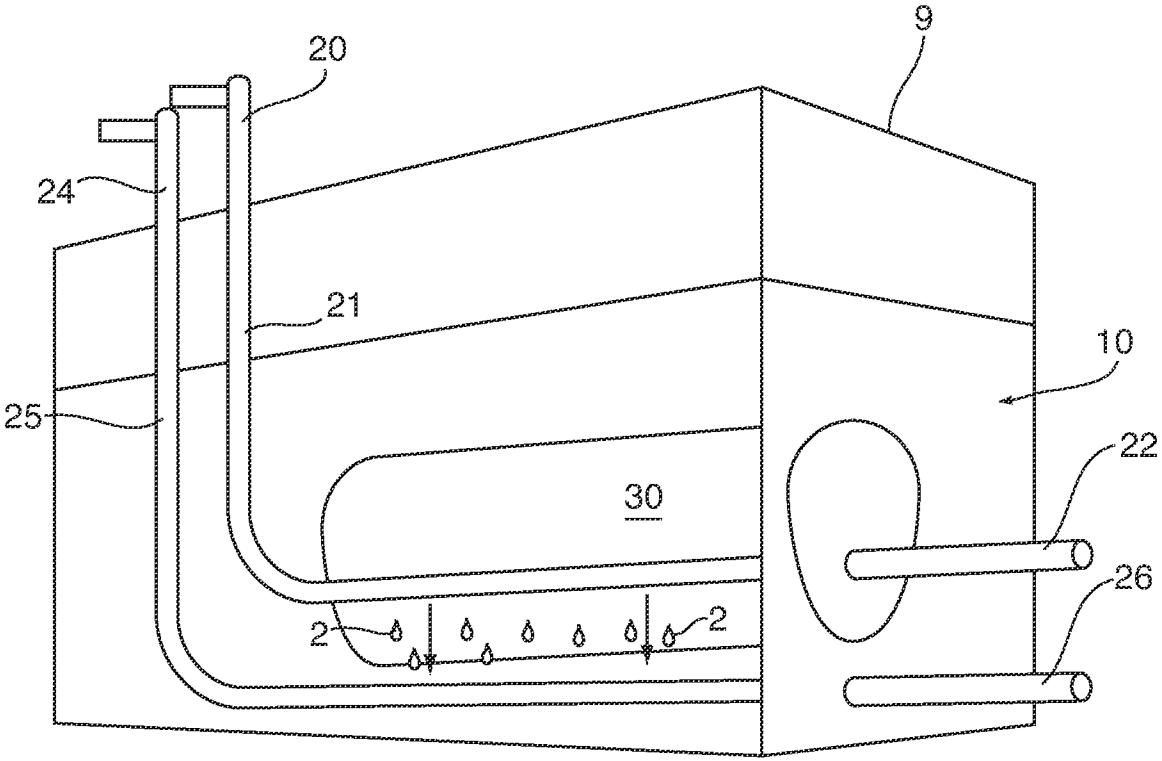
Fig.2 ( Prior Art )
FIG. 2 is a schematic perspective view of the prior art SAGD method of recovering oil from an underground reservoir, showing the heating accomplished by the upper steam injection well, and the draining downwardly of the heated oil for collection by the collection well.

FIG. 2 is a schematic perspective view of the prior art SAGD method of recovering oil 2 from an underground reservoir 10. In such prior art SAGD method, a steam injection well 20 having a vertical component 21 and a horizontal portion 22, and a production well 24, having a vertical portion 25 and a horizontal portion 26, are drilled centrally within a reservoir 10 or portion of a reservoir 10 that is desired to be exploited. Preferably the horizontal portion 22 of the steam injection well 20 is located relatively high in the formation 10, and directly above the horizontal portion 26 of the production well 24, which is located relatively low in formation 10.

Hot steam 30 is injected in injection well 20 and into the formation via apertures (not shown) in injection well 20 and heats oil 2 in formation 10. Heated oil 2, rendered mobile or more mobile as a result of such heating, is caused by gravity to drain downwardly within reservoir/formation 10, where it enters horizontal portion 26 of production well 24 via apertures therein (not shown), and is thereafter produced to surface 9.

Again, as noted in the background of the invention herein, the Steam/Oil ratio (SOR) with respect to such prior art SAGD methods, for thicker oils, is typically very high, meaning that considerable expense and effort need be undertaken when using SAGD recovery methods to heat significant quantities of water to produce large volumes of steam in order to obtain the higher rates and percentage of oil recovery in such SAGD method.

FIGS. 3-11 shown various methods of the present invention using water injection with the method of SAGD.

Figure 3:
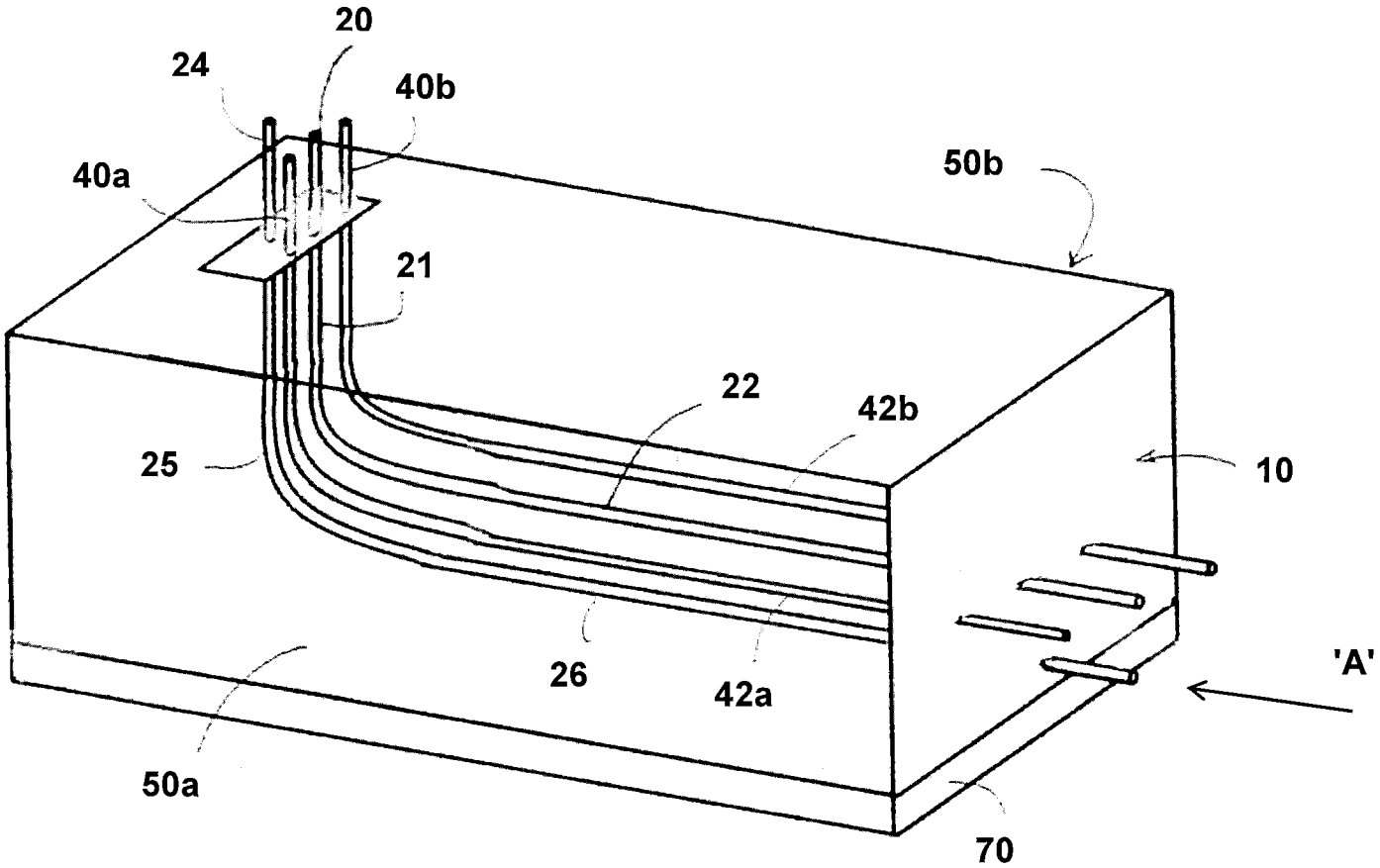
FIG. 3 is a perspective schematic view of a first embodiment of the method of the present invention being practised on an underground reservoir, showing horizontal portions of a a fluid injection well and a horizontal portion of the collector well being bounded on respectively opposite sides by a pair of water injection wells which thus respectively bound the reservoir (or portion of the reservoir) being produced with such liquid injection wells.

FIG. 3 shows a perspective schematic view of a first embodiment of the method of the present invention being practised on a development region of underground reservoir 10. In such first embodiment, as in the prior art SAGD method of FIG. 2, a steam injection well 20 having a vertical component 21 and a horizontal portion 22, and a production well 24, having a vertical portion 25 and a horizontal portion 26, are drilled centrally within a reservoir 10, namely within a development region of a portion of a reservoir 10) that is desired to be exploited. Preferably the horizontal portion 22 of the steam injection well 20 is located relatively high in the formation 10, and directly above the horizontal portion 26 of the production well 24, which is located relatively low in formation 10.

In addition, however, in such first embodiment a pair of liquid injection wells 40*a*, 40*b*, each having a horizontal portion 42*a*, 42*b* drilled parallel to the horizontal portion 22 of steam injection well 20, are provided. Such horizontal portions 42*a*, 42*b*, of liquid injection wells 40*a*, 40*b*, have a series of apertures therein (not shown) to allow egress of liquid therefrom, and are preferably positioned (drilled) along mutually opposite side edges 50*a*, 50*b* of reservoir 10, so as to effectively bound the reservoir 10 along such mutually opposite side edges 50*a*, 50*b*, with the horizontal portion of production well 24 located substantially centrally within such reservoir 10.

Accordingly, in accordance with the first embodiment of the present invention, hot steam 30 is injected in injection well 20 and into the formation via apertures (not shown) in injection well 20 and heats oil 2 in formation 10. Simultaneously, or preferably after a short internal when oil 2 in such formation above said horizontal portion 22 of steam injection well 20 has become heated and commenced draining downwardly and begun to be collected in horizontal portion 26 of production well 24 and commenced being produced to surface 9, water 8 is then injected into liquid injection wells 40*a*,40*b* and enters formation 10 via horizontal portions 42*a*, 42*b* of respective liquid injection wells 40*a*, 40*b*, blocking escape of oil 2 and steam 30 laterally away from production well 20, and further causing displacement of a portion of oil 2 along side edges 50*a*, 50*b* of reservoir 10 in the direction of the centrally-located horizontal portion 26 of production well 24, thereby allowing such oil to be collected in production well 24 and produced to surface.

Notably, while a benefit of injection of water 8 and displacement of oil 2 toward production well 26 would seemingly serve the function of replacing oil 2 voided from region 70 immediately surrounding horizontal portion 26 of production well 24 and thereby preserving the pressure of the oil 2 in region 70, practically speaking such maintenance of pressure in a SAGD recovery method is not typically needed or even necessarily desirable due to the continual downward draining of heated oil 2 by force of gravity, which tends to continuously fill voided regions 70 immediately surrounding horizontal portion 26 of production well 24. Accordingly, a person of skill in the art would not, due to injection of water to maintain reservoir pressures in traditional non-SAGD applications, be led to use water injection in a SAGD recovery application. Surprisingly, however, the very advantageous benefit of injection of water 8 along mutual side edges 50*a*, 50*b* of development region of reservoir 10 in a SAGD recovery method is the strategic location of such injection of water 8, which due to being injected in such location along side edges of the region of the reservoir 10 under development, substantially blocks any lateral migration of both heated oil 2 and steam 30 laterally outwardly and away from the horizontal portion 26 of production well 24 which would otherwise occur in absence of such water injection along side edges 50*a*, 50*b*. Specifically, the level of the horizontal portion 26 of production well 24 is in a lowermost portion of reservoir 10, which reservoir 10 is typically directly above a layer of substantially impervious rock layer 60. In absence of such water injection along side edges 50*a*, 50*b* of reservoir 10, oil 2 and steam 30 above horizontal portion 26 of production well 24 may potentially be and often is deflected laterally outwardly after downward draining in the SAGD process. Injection of water 8 along side edges 50*a*, 50*b* prevents this. Specifically, water injection along side edges 50*a*, 50*b* prevents oil 2 that would otherwise, when draining downwardly, be laterally deflected outwardly and away from horizontal portion 26 of production well 24. Accordingly, oil 2 and steam 30 is prevented by such water injection along lateral side edge 50*a*, 50*b* from migrating laterally outwardly from production well 24, and is further prevented from migrating downwardly by impervious rock layer 60, and thus has no choice but to migrate inwardly in the direction of horizontal portion 26 of production well 24 and be produced to surface 9. A further benefit is that such injection of water 8 further displaces oil 2 along side edges 50*a*, 50*b* of a development region toward the middle of the development region, where it can be collected by the horizontal producer.

Figure 4:
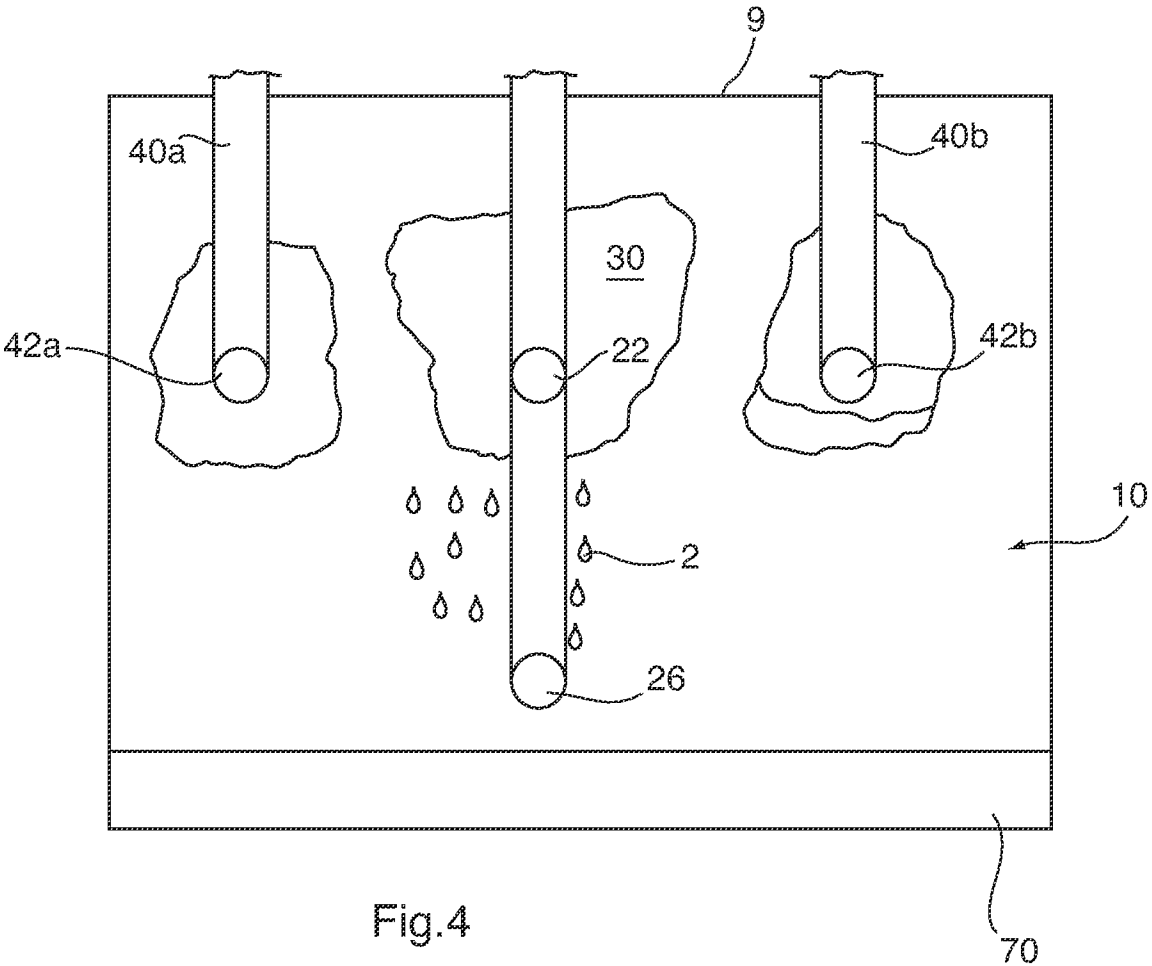
FIG. 4 is a view on arrow "A" of FIG. 3.
Figure 5:
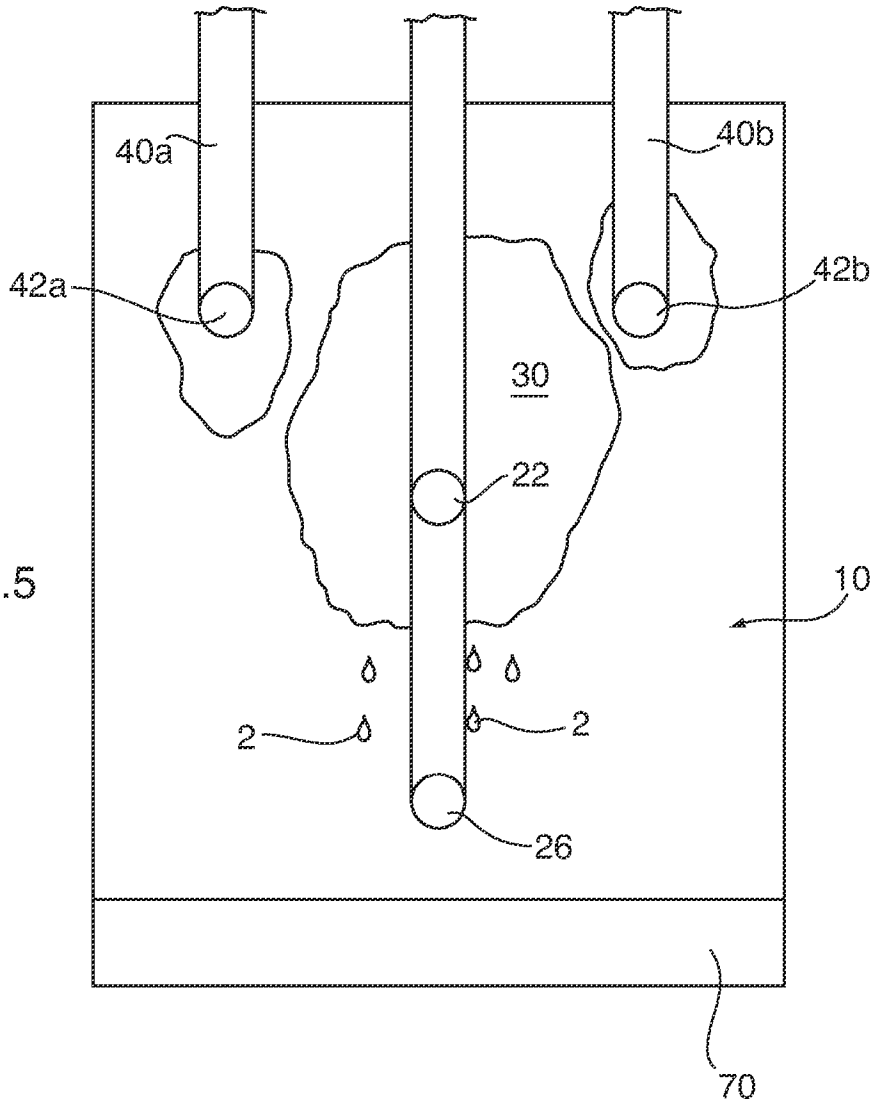
FIG. 5 is a view similar to FIG. 4, showing an alternate vertical location for positioning of the pair of liquid injection wells shown in FIG. 3 and FIG. 4.

FIG. 4, being a view on arrow 'A' of FIG. 3, shows a preferred embodiment of the location of the horizontal portions 42*a*, 42*b* of water injector wells 40*a*, 40*b*, namely along and adjacent respective side edges 50*a*, 50*b* of reservoir 10, at the approximate level of the horizontal portion 22 of the steam injector well 20. However, such horizontal portions 42*a*, 42*b* of water injection wells 40*a*, 40*b* may be positioned at a level in the reservoir 10 below the horizontal portion 22 of steam injector well 20, or at a region slightly above the level of the horizontal portion 22 of steam injector well 20, as shown in FIG. 5, and may be evenly (or unevenly laterally spaced from the vertical portion 21 of steam injection well 20, depending on porosity of the formation 10 in various regions as advantageously measured when drilling such injection wells 20 and 40*a*, 40*b*, and other variables.

Figure 6:
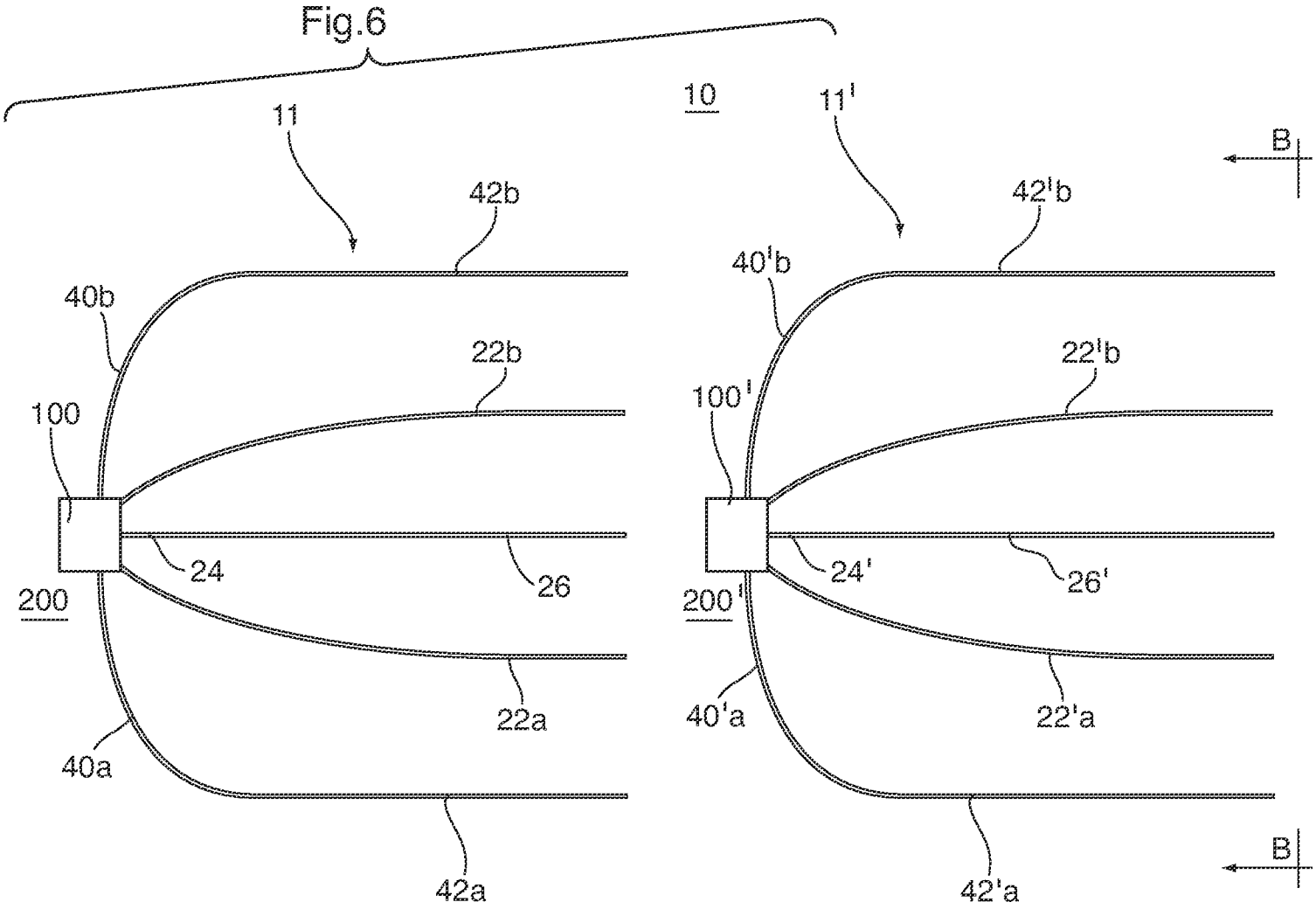
FIG. 6 is a schematic top view of formation being exploited in one of the methods of the present invention, wherein a pair of liquid injection wells are situated along mutually opposite side edges of each portion of the reservoir being exploited, and a series of fluid injector and collector wells are arranged in mutual end-to-end juxtaposed relation, each series of fluid injector and collector wells having disposed on either side thereof a parallel liquid injector well.

FIG. 6 is a schematic top view of formation 10 being exploited in a variation of the above method of the present invention, wherein successive development regions 11, 11' of reservoir 10 are sequentially developed and exploited in an end-to-end manner, as shown in FIG. 6.

Typically in such end-to-end successive exploitation of a reservoir 10, vertical-horizontal well pairs, be they either production wells 24, 24' or injection wells 20, 20' or 40, 40', are typically all drilled for convenience sake from single locations 100, 100', such as from single clearings 100, 100' in a jungle, or from single raised drilling platforms 100, 100' for a reservoir 10 located offshore.

In such end-to-end successive exploitation method, a horizontal portion 26 of a first production well 24 is arranged in an end-to end relationship with a horizontal portion 26' of a second production well 24'. Likewise, horizontal portions 22*a*,22*b* of a pair of first steam injection wells 20*a*, 20*b* are respectively drilled in substantial end-to-end relation with a respective horizontal portions 22'*a*, 22'*b* of a second steam injector wells 20'*a*, 20'*b*, as shown in FIG. 6. In the embodiment shown in FIG. 6, the steam injector wells 20*a*, 20*b* and 20'*a*, 20'*b* are respectively disposed on either side thereof a production well 24, 24', as shown in FIG. 6. Alternatively, only one steam injector well 20, 20' may be utilized with each associated production well 24, 24', and respectively located vertically above such production wells 24, 24'.

As also seen from the method depicted in FIG. 6, horizontal portions 42*a*, 42*b* of a pair of first water injection wells 40*a*, 40*b* are respectively drilled in substantial end-to-end relation with respective horizontal portions 42'*a*, 42'*b* of a second water injector wells 40'*a*, 40'*b* as shown in FIG. 6.

Accordingly, in the manner described above for one production well 24, where a series of production wells 24, 24' are arranged in an end-to end configuration as shown in FIG. 6, hot steam 30 is injected in each steam injection well 20, 20' and into the formation via apertures (not shown) in injection wells 20, 20'. Such hot steam 30 heats oil 2 in formation 10. Simultaneously, or preferably after a short time interval when oil 2 in such formation above horizontal portions 22, 22' of steam injection wells 20, 20' has become heated and commenced draining downwardly and begun to be collected in production wells horizontal portions 26, 26' of production wells 24, 24', water 8 is then injected into liquid injection wells 40*a*,40*b* and 40'*a*,40'*b* and enters development regions 11, 11' via horizontal portions 42*a*, 42*b* and 42'*a*, 42'*b* of respective water injection wells 40*a*, 40*b*, and 40'*a*,40'*b* thereby blocking escape of oil 2 laterally away from horizontal portions 26, 26' of production wells 24, 24'. The lateral migration of steam 30 is also prevented from leaving the development regions 11, 11' of reservoir 10 by such injected water 8, which further causes displacement of a portion of oil 2 along side edges 50*a*, 50*b*, 50'*a*, 50'*b* of development regions 11, 11' in the direction of the centrally-located horizontal portions 26, 26' of production wells 24, 24', thereby allowing such oil 2 to be collected in production wells 24, 24' and produced to surface 9, and further preventing steam 30 injected into such development regions 11, 11' of reservoir 10 from escaping such regions, thereby allowing for increased heat transfer and heating of oil 2 in such regions, thereby further increasing the sweep efficiency of the SAGD method and increasing the percentage recovery of OOIP per volume of injected steam 30.

Figure 7:
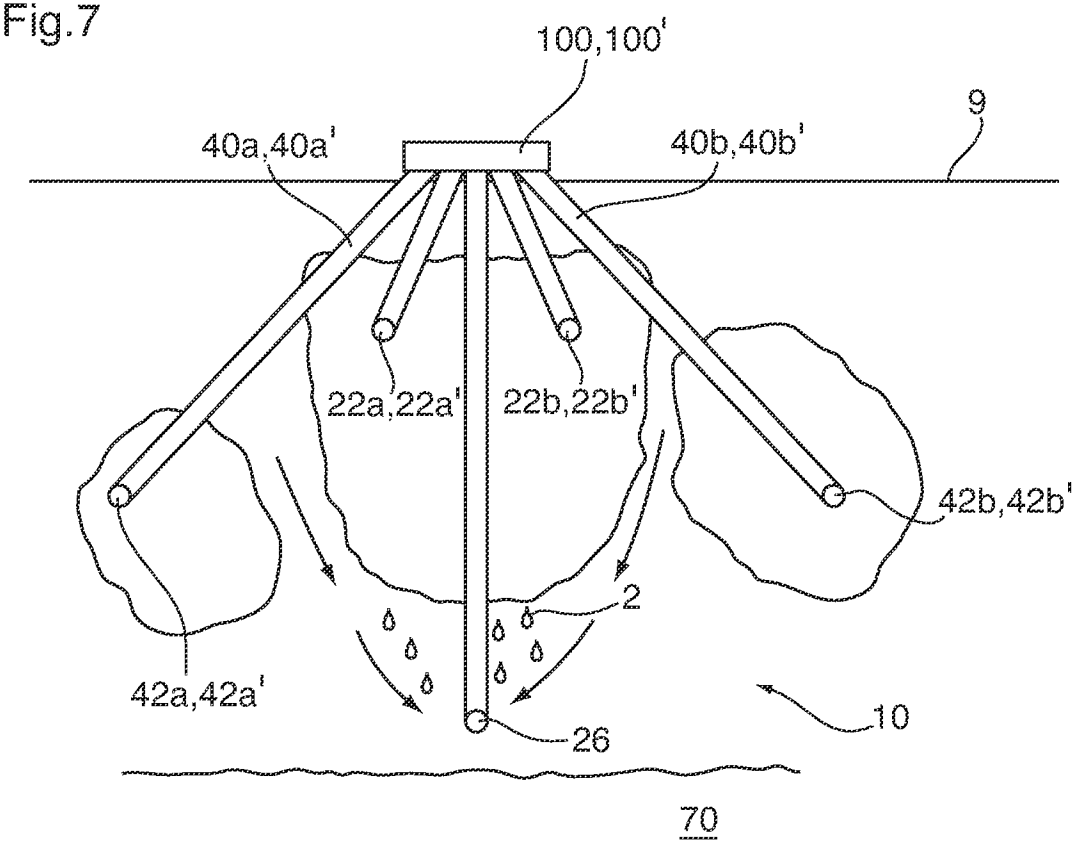
FIG. 7 is a view taken along plane "B-B" of FIG. 6.

FIG. 7 is a view taken on plane B-B of FIG. 6, showing a preferred relative vertical location of the horizontal portions 22*a*, 22*b*, and 22'*a*, 22'*b* of steam injector wells 20, 20' relative to horizontal portions 26, 26' of production wells 24, 24', and relative to horizontal portions 42*a*, 42*b* and 42'*a*, 42'*b* of respective water injection wells 40*a*, 40*b* and 40*a*', 40*b*'. Of course the relative heights may be adjusted one relative to the other to account for different porosity of the reservoir in various locations, but generally the vertical relationship one to the other will be as shown in FIG. 7.

Figure 8:
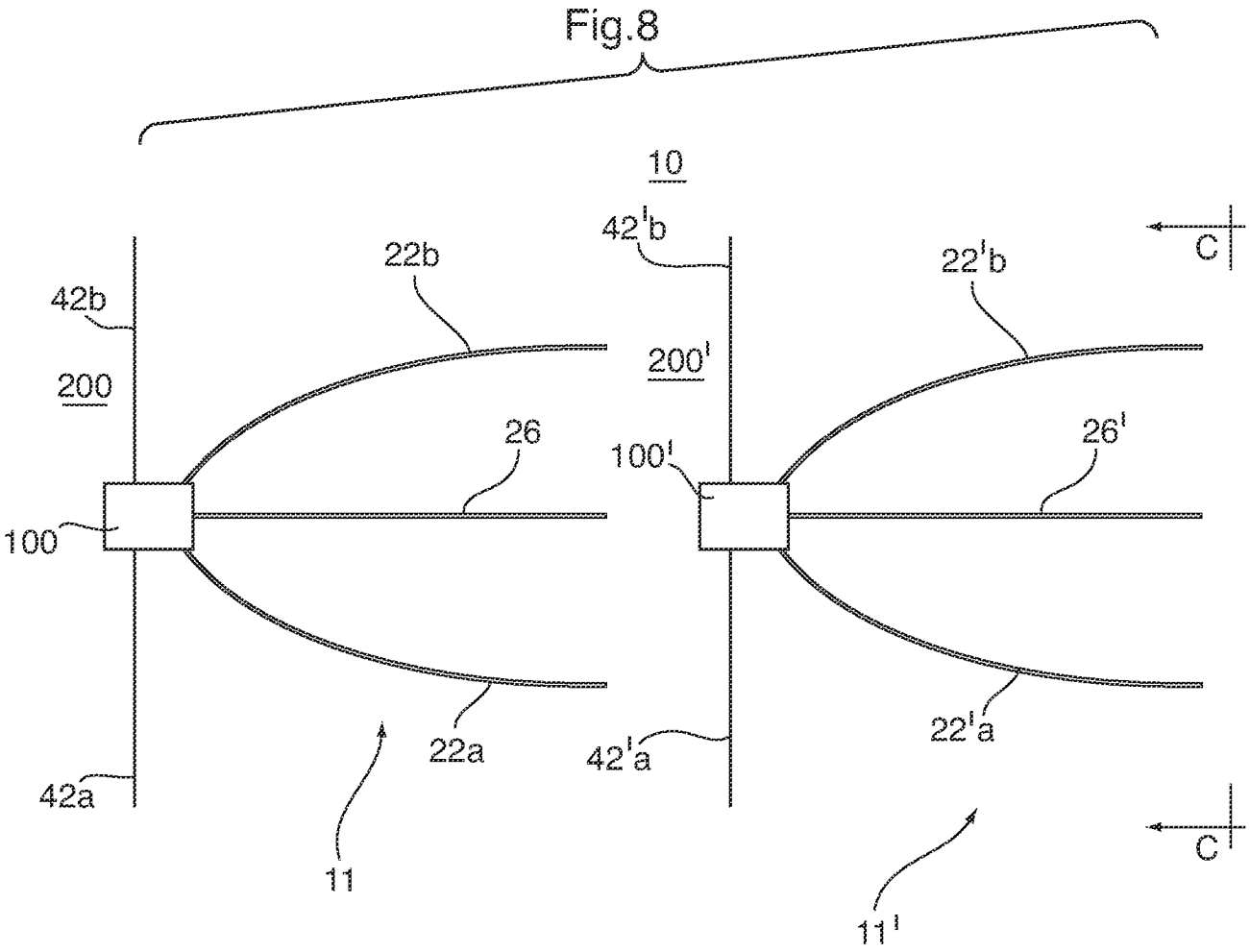
FIG. 8 is a schematic top view of a formation being exploited in the manner of another of the methods of the present invention, wherein a pair of liquid injection wells are situated along mutually opposite side edges of each portion of the reservoir being exploited, where a series of fluid injector and collector wells are arranged in mutual end-to-end juxtaposed relation.

FIG. 8 shows another schematic top view of reservoir 10 being exploited in development regions 11, 11' in a variation of the above method of the present invention wherein successive development regions 11, 11' are sequentially developed and exploited in a successive end-to-end manner similar to FIG. 6, but where instead of horizontal portions 42*a*, 42*b* and 42'*a*, 42'*b* of respective water injection wells 40*a*, 40*b* and 40'*a*, 40'*b* being located on respective mutually opposite sides 50*a*, 50*b* and 50'*a*, 50'*b* of development regions 11, 11' respectively, horizontal portions 42*a*, 42*b* and 42'*a* 42'*b* of water injection wells 40*a*, 40*b*, and 40'*a*, 40'*b* are instead located at ends 200, 200' respectively of development regions 11, 11', with such horizontal portions extending laterally outwardly from platform/clearing 100, 100', and substantially perpendicular to the horizontal portion 26, 26' of production wells 24, 24'.

Figure 9:
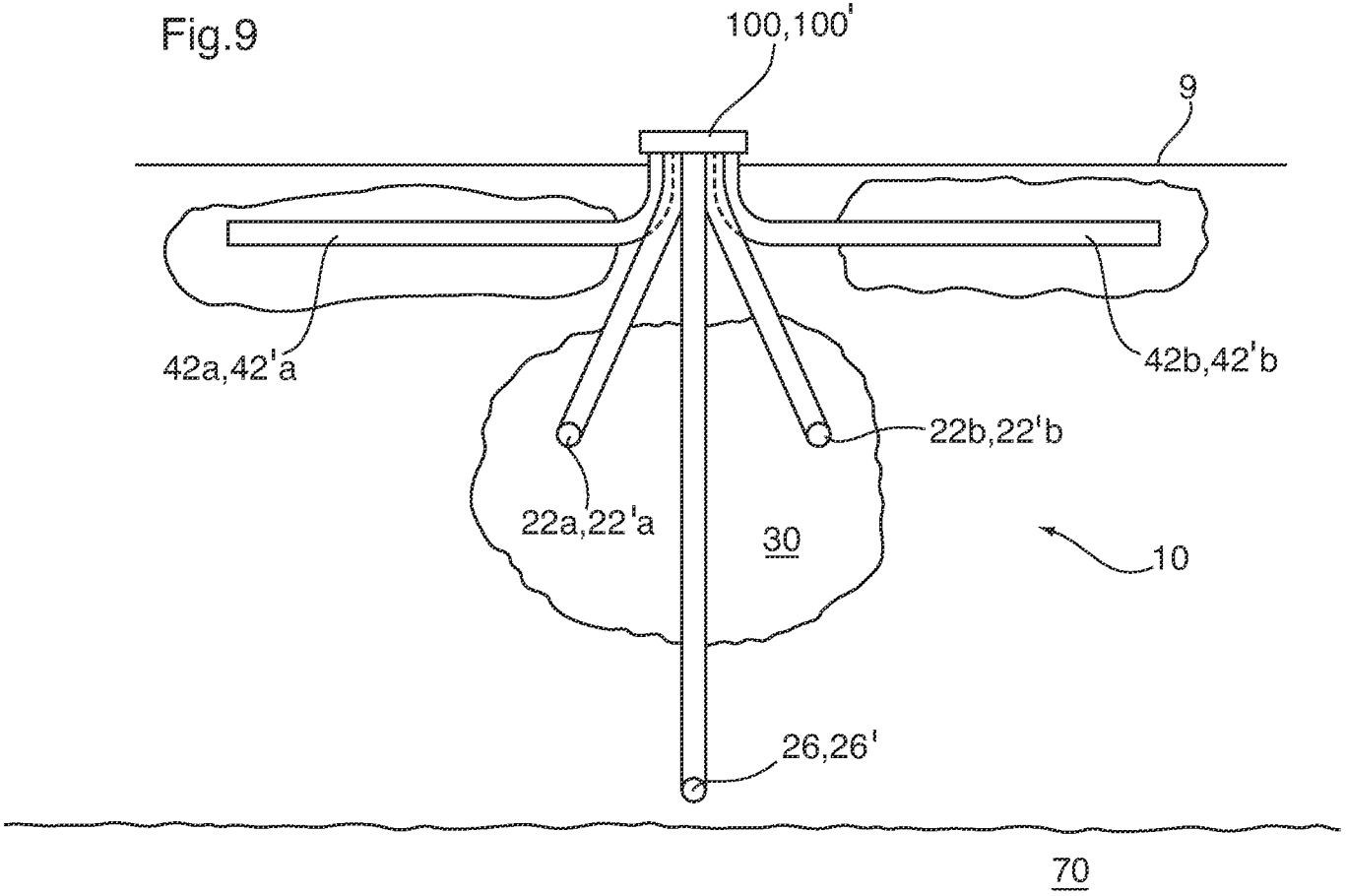
FIG. 9 is a view taken along plane "C-C" of FIG. 8.

FIG. 9 is a view taken on plane C-C of FIG. 8, showing a preferred relative vertical location of the horizontal portions 22*a*, 22*b*, and 22'*a*, 22'*b* of steam injector wells 20, 20' relative to horizontal portions 26, 26' of production wells 24, 24', and relative to horizontal portions 42*a*, 42*b* and 42'*a*, 42'*b* of respective water injection wells 40*a*, 40*b* and 40*a*', 40*b*'. Of course the relative heights may be adjusted one relative to the other to account for different porosity of the reservoir in various locations, but generally the vertical relationship one to the other will be as shown in FIG. 9.

Figure 10:
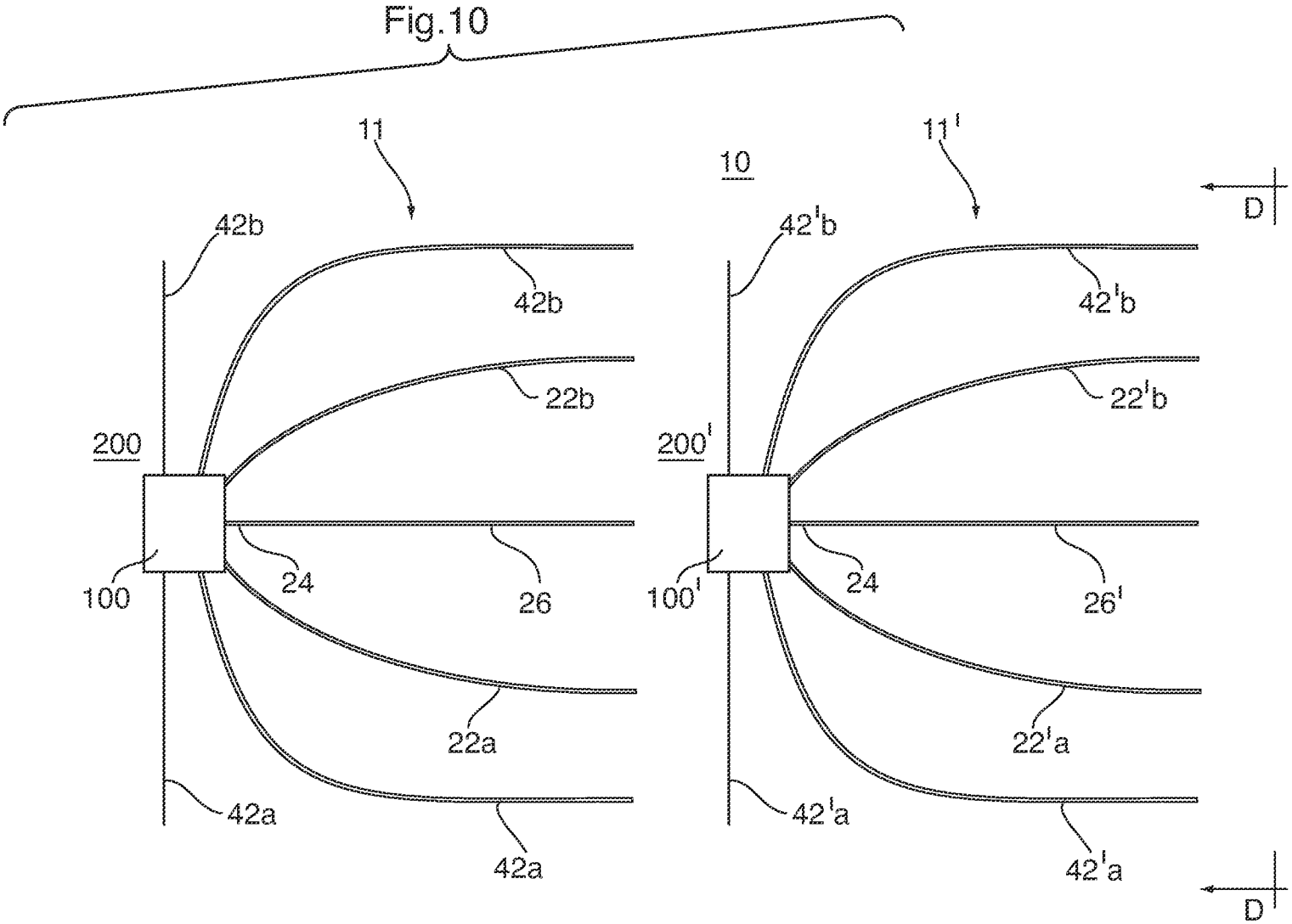
FIG. 10 is a schematic top view of a formation being exploited in the manner of another of the methods of the present invention, which methods combines the methods shown in each of FIG. 6 and FIG. 8.

FIG. 10 shows a preferred embodiment of the method of the present invention, namely a method for successive end-to-end exploitation of a reservoir 10 using a series of production wells 24, 24' and steam injection wells 20, 20', wherein the methods of FIG. 6 and FIG. 8 are combined. Specifically, such method uses laterally outwardly extending water injection wells 40*a*, 40*b* and 40'*a*, 40'*b* positioned at ends 200, 200' of respective development regions 11, 11', as well as longitudinally aligned water injection wells 40*a*, 40*b* and 40'*a*, 40'*b*, having corresponding horizontal portions 42*a*, 42*b*, and 42'*a*, 42'*b* aligned along mutually opposite side edges 50*a*, 50*b*, and 50'*a*, 50'*b* of development regions 11, 11'.

Figure 11:
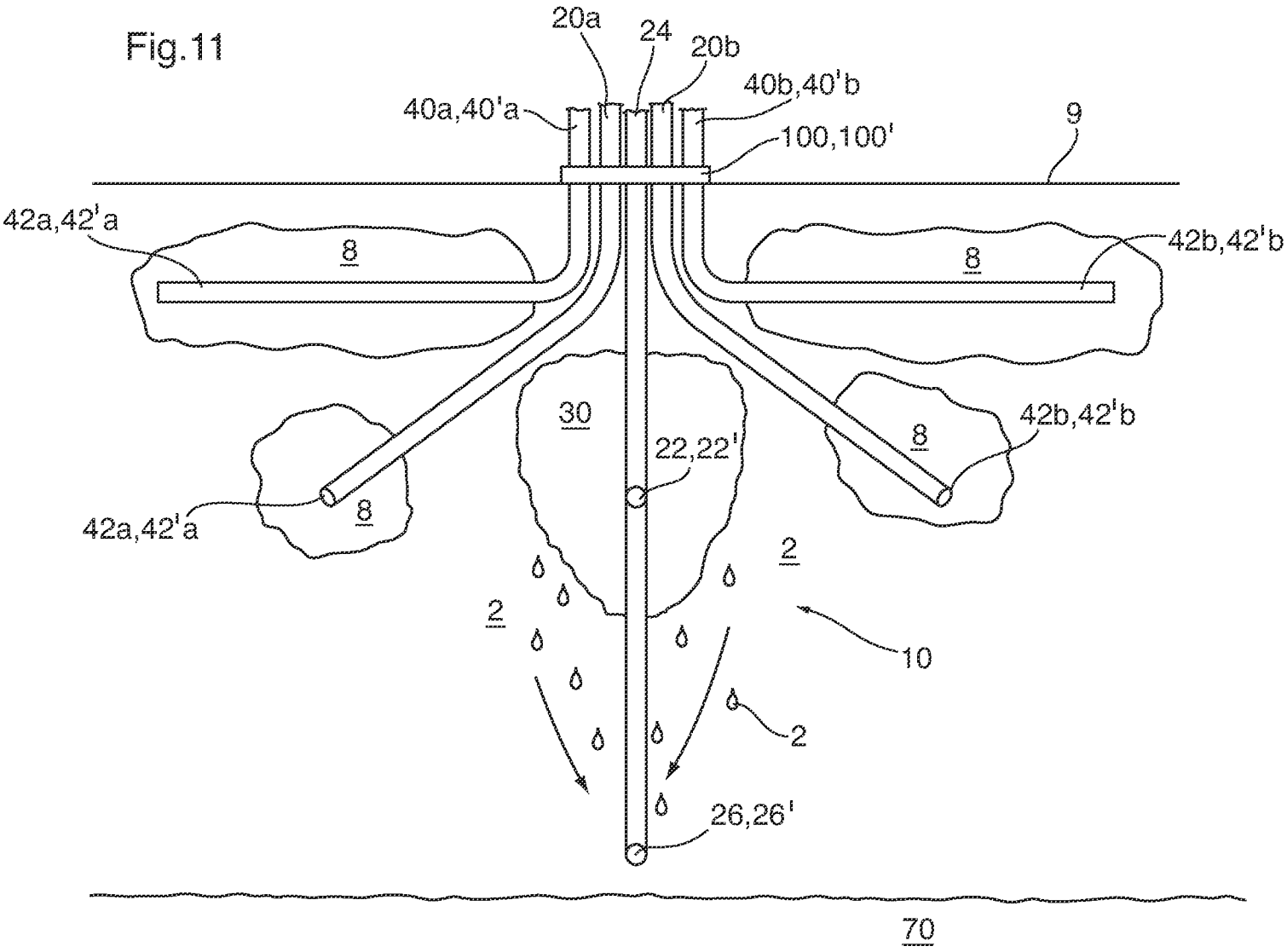
FIG. 11 is a view taken along plane "D-D" of FIG. 10.

FIG. 11 is a view taken on plane "D-D" of FIG. 10, showing a preferred relative vertical location of the horizontal portions 22*a*, 22*b*, and 22'*a*, 22'*b* of steam injector wells 20, 20' relative to horizontal portions 26, 26' of production wells 24, 24', and relative to horizontal portions 42*a*, 42*b* and 42'*a*, 42'*b* of respective water injection wells 40*a*, 40*b* and 40*a*', 40*b*'. Of course the relative heights may be adjusted one relative to the other to account for different porosity of the reservoir in various locations, but generally the vertical relationship one to the other will be as shown in FIG. 11 in such preferred embodiment of the method of the present invention.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. An improved thermal oil recovery method for recovering oil from a development region of a hydrocarbon-containing subterranean reservoir, comprising the steps of:

(i) drilling a first heated fluid injection well, having a horizontal portion extending into said development region and adapted for injecting a heated fluid into said development region;

(ii) drilling a first production well within said development region, having a horizontal portion situated parallel with but positioned below said horizontal portion of said first heated fluid injection well, said production well adapted for collecting heated oil from said development region;

(iii) drilling at least one liquid injection well along at least one side edge of said development region;

(iv) injecting a heated fluid such as steam into said first heated fluid injection well and into the development region via said horizontal portion of said heated fluid injection well;

(v) injecting a liquid such as water into said liquid injection well along said one side edge of said development region to create a pressurized zone at said one side edge to reduce flow of the heated fluid and/or heated oil past said pressurized zone; and (vi) collecting and producing to surface the heated oil within said reservoir that has flowed into said production well.

2. The improved oil recovery method as claimed in claim 1, wherein the step of drilling at least one liquid injection well comprises the step of drilling a plurality of liquid injection wells at locations which bound the development region, wherein the horizontal portion of said first production well extends into a central area of said development region, and the step of injecting a liquid such as water into said liquid injection well along said one side edge of the development region comprises injecting said liquid such as water into said plurality of liquid injection wells at said locations which bound the development region, to create a pressurized zone around the development region to reduce flow of the heated fluid and/or the heated oil past said pressurized zone.

3. The improved oil recovery method as claimed in claim 1, wherein the drilling of at least one liquid injection well in step (iii) further comprises the step of drilling said liquid injection well in a manner so as to provide a horizontal portion thereof along at least one side edge of said development region, so as to bound said development region along said at least one side edge thereof.

4. The improved oil recovery method as claimed in claim 2, wherein step (iii) and (v) respectively further comprise:

drilling second and third mutually parallel liquid injection wells, each having a horizontal portion positioned parallel to and on opposite sides of said horizontal portion of said first heated fluid injection well and above said horizontal portion of said production well further respectively bounding said development region of reservoir along mutually opposite side edges thereof; and injecting said liquid into each of said liquid injection wells.

5. The improved oil recovery method as claimed in claim 1, wherein step (iii) further comprises:

drilling second and third liquid injection wells, each having a horizontal portion extending outwardly and in mutually opposite directions along one edge of said development region, each of said horizontal portions thereof disposed perpendicular to said horizontal portions of said production well and said first heated fluid injection well.

6. A method for recovering oil from a hydrocarbon-containing subterranean reservoir as claimed in claim 1, wherein said liquid is substantially comprised of water.

7. A method for recovering oil from said development region as claimed in claim 1, wherein said liquid is substantially comprised of water.

8. A method for recovering oil from said development region as claimed in claim 7, wherein said water comprises produced water produced and recovered from said development region.

9. An improved thermal recovery method for recovering oil from a development region of a hydrocarbon-containing subterranean reservoir, comprising the steps of:

(i) drilling a first heated fluid injection well, having a horizontal portion for injecting a heated fluid such as steam into the development region;

(ii) drilling a first production well, having a horizontal portion positioned relatively low in said development region and parallel with but positioned below said horizontal portion of said first heated fluid injection well, for collecting and producing oil from said development region;

(iii) drilling a first liquid injection well, having a horizontal portion substantially perpendicular to said horizontal portion of said production well and situated along at least a portion of one side of said development region so as to bound said development region along at least a portion of one side edge thereof;

(iv) drilling second and third mutually parallel liquid injection wells, each positioned parallel to said horizontal portion of said production well along mutually opposite sides of said first heated fluid injection well so as to bound said development region along mutually opposite side edges thereof;

(v) injecting a heated fluid such as steam into said first heated fluid injection well and into the development region via said horizontal portion of said fluid injection wells;

(vi) injecting a liquid such as water into said first, second and third liquid injection wells to create a pressurized zone around the development region to reduce flow of the heated fluid and/or heated oil past said pressurized zone; and (vii) collecting and producing to surface the oil within said development region that has become heated by said heated fluid and drained downwardly in said development region.

10. The method as claimed in claim 9, wherein each of said liquid injection wells have a horizontal portion situated above said production well, at approximately a height of said first heated fluid injection well.

11. A method for recovering oil from a hydrocarbon-containing subterranean reservoir as claimed in claim 9, wherein said heated fluid is substantially comprised of steam.

12. A method for recovering oil from a hydrocarbon-containing subterranean reservoir as claimed in claim 9, wherein said liquid is substantially comprised of water.

13. A method for recovering oil from said development region as claimed in claim 9, wherein said liquid is substantially comprised of water.

14. A method for recovering oil from said development region as claimed in claim 13, wherein said water comprises produced water that is produced and recovered from said reservoir.

15. An improved thermal method for recovering oil from a development region of a hydrocarbon-containing subterranean reservoir, comprising the steps of:

(i) drilling a first heated fluid injection well which has a portion which extends into said development region of said reservoir, said first heated injection well adapted for injecting a heated fluid such as steam into said development region to heat the oil so it may flow in said development region;

(ii) drilling a first production well having a portion which extends into said development region, said first production well adapted for collecting the so-heated oil resulting from step (i) from said development region;

(iii) drilling at least one liquid injection well along at least one side edge of said development region;

(iv) injecting a heated fluid such as steam into said first heated fluid injection well and into said development region via said first heated fluid injection well;

(v) injecting a liquid such as water into said liquid injection well along said one side edge of said development region to create a pressurized zone at said one side edge to reduce flow of the heated fluid and/or heated oil past said pressurized zone; and (vi) collecting and producing to surface the heated oil within said reservoir which has flowed into said production well.

16. The improved thermal method for recovering oil as claimed in claim 15, wherein:

said portion of said first heated fluid injection well which extends into said development region is substantially horizontal;

said portion of said first production well which extends into said development region is substantially horizontal, and which is parallel to, but positioned in said development region below said horizontal portion of said first heated fluid injection well.

17. The improved thermal method for recovering oil as claimed in claim 16, wherein:

said at least one liquid injection well has a horizontal portion which extends along at least one side edge of said development region; and said horizontal portion of said at least one liquid injection well is positioned in said development region above or at a level of said horizontal portion of said first production well, and substantially parallel thereto.

18. An improved thermal method for recovering oil from a development region of a hydrocarbon-containing subterranean reservoir, comprising the steps of:

(i) drilling a first well which extends into said development region of said reservoir, said first well adapted for periodically (a) injecting a heated fluid such as steam into said development region so as to heat the oil so it may flow in said reservoir, followed by (b) collecting and producing the so-heated oil to surface;

(ii) drilling at least one liquid injection well along at least one side edge of said development region;

(iii) injecting a liquid such as water into said liquid injection well to create a pressurized zone at said one side edge;

(iv) injecting a heated fluid such as steam into said development region via said first well for a time sufficient to heat the oil in said development region so that oil may flow in the reservoir, said pressurized zone to reduce flow of the heated fluid and/or heated oil past said pressurized zone; and (v) collecting and producing to surface the heated oil after step (iv) from within said reservoir via said first well.

19. An improved method for recovering oil from said development region as claimed in claim 18, wherein steps (iv) to (v) are repeated at least once.

20. An improved method for recovering oil as claimed in claim 18, wherein:

said first well which extends into said development region is substantially horizontal within said development region;

said at least one liquid injection well along said one side edge of said development region is substantially horizontal and substantially parallel to said horizontal portion of said first well.

21. An improved method for recovering oil as claimed in claim 20, wherein:

said horizontal portion of said liquid injection well is located at a height in said development region approximately equal to said first well.

* * * * *